US009551534B2

(12) United States Patent
Errick et al.

(10) Patent No.: US 9,551,534 B2
(45) Date of Patent: Jan. 24, 2017

(54) HEAT EXCHANGER ASSEMBLY HAVING A SEAL

(75) Inventors: Steven David Errick, Royal Oak, MI (US); John Azar, LaSalle (CA)

(73) Assignee: Ford Global Technologies, LLC, Dearborn, MI (US)

( * ) Notice: Subject to any disclaimer, the term of this patent is extended or adjusted under 35 U.S.C. 154(b) by 787 days.

(21) Appl. No.: 13/424,451

(22) Filed: Mar. 20, 2012

(65) Prior Publication Data

US 2012/0247731 A1 Oct. 4, 2012

Related U.S. Application Data

(60) Provisional application No. 61/469,180, filed on Mar. 30, 2011.

(51) Int. Cl.

| | |
|---|---|
| ***B60H 1/00*** | (2006.01) |
| ***F28F 27/02*** | (2006.01) |
| ***F28D 1/00*** | (2006.01) |
| ***F28D 1/04*** | (2006.01) |
| *F28F 9/00* | (2006.01) |

(52) U.S. Cl.

CPC ..... *F28D 1/0435* (2013.01); *F28F 9/001* (2013.01)

(58) Field of Classification Search

CPC .. F28D 1/053; F28D 1/05308; F28D 1/05358; F28F 9/001; F28F 9/002; F28F 27/02; F28F 9/22

See application file for complete search history.

(56) References Cited

U.S. PATENT DOCUMENTS

| | | | | |
|---|---|---|---|---|
| 3,938,587 | A * | 2/1976 | Vian | 165/76 |
| 4,831,844 | A | 5/1989 | Kadle | |
| 5,743,328 | A * | 4/1998 | Sasaki et al. | 165/144 |
| 6,019,161 | A | 2/2000 | Travis | |
| 6,298,908 | B1 * | 10/2001 | Harrell et al. | 165/69 |
| 6,817,404 | B2 | 11/2004 | Frana-Guthrie et al. | |
| 2001/0040021 | A1 * | 11/2001 | Avequin et al. | 165/67 |
| 2004/0035551 | A1 * | 2/2004 | Tamura et al. | 165/41 |
| 2004/0177949 | A1 * | 9/2004 | Shimoya et al. | 165/152 |
| 2005/0006071 | A1 * | 1/2005 | Kovac | 165/140 |
| 2008/0185136 | A1 | 8/2008 | Vastine et al. | |
| 2008/0303225 | A1 * | 12/2008 | Franz et al. | 277/630 |

OTHER PUBLICATIONS

"Automotive Air Conditioning Condensers," P. Parish, http://www.e38.org/pparish/cond.htm, publication date unknown.

"Tech Tip—Inadequate Condenser Air Flow," Four Seasons division of Standard Motor Products, Inc., http://www.4s.com/Upload/Four%20Seasons/documents/Tech%20Tips/English/45%20371%20Condensers%20Air%20Flow.pdf., publication date unknown.

* cited by examiner

*Primary Examiner* — Allen Flanigan
*Assistant Examiner* — Jason Thompson
(74) *Attorney, Agent, or Firm* — Vichit Chea; Brooks Kushman P.C.

(57) ABSTRACT

A heat exchanger assembly having first and second heat exchangers and a seal. The seal may be disposed on the first heat exchanger and may have an elongated portion that extends toward the second heat exchanger to direct the flow of cooling air.

14 Claims, 3 Drawing Sheets

HEAT EXCHANGER ASSEMBLY HAVING A SEAL

CROSS-REFERENCE TO RELATED APPLICATIONS

This application claims the benefit of U.S. provisional Application No. 61/469,180 filed Mar. 30, 2011, the disclosure of which is incorporated in its entirety by reference herein.

TECHNICAL FIELD

This application relates to a heat exchanger assembly and a seal that may be provided with a heat exchanger assembly.

SUMMARY

In at least one embodiment, a heat exchanger assembly is provided. The heat exchanger assembly may include first and second heat exchangers and a seal. The first and second heat exchangers may be separated by a gap. The seal may be disposed on the first heat exchanger and may have an elongated portion that extends across the gap toward the second heat exchanger. The seal may direct cooling air that flows through the first heat exchanger to the second heat exchanger.

In at least one embodiment, a heat exchanger assembly is provided. The heat exchanger assembly may include a first heat exchanger, a second heat exchanger, and a seal. The first heat exchanger may have a first core. The second heat exchanger may have a second core. The second core may be disposed substantially parallel to the first core and may be spaced apart from the first core. The seal may have a set of tabs that extend along a front surface of the first core. Each member of the set of tabs may have a fastener that extends at least partially through the first core toward the second heat exchanger to secure the seal to the first heat exchanger. The seal may include an elongated portion that extends in a cantilevered manner from the first core toward the second core. The elongated portion may direct cooling air that flows through the first core to the second core.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
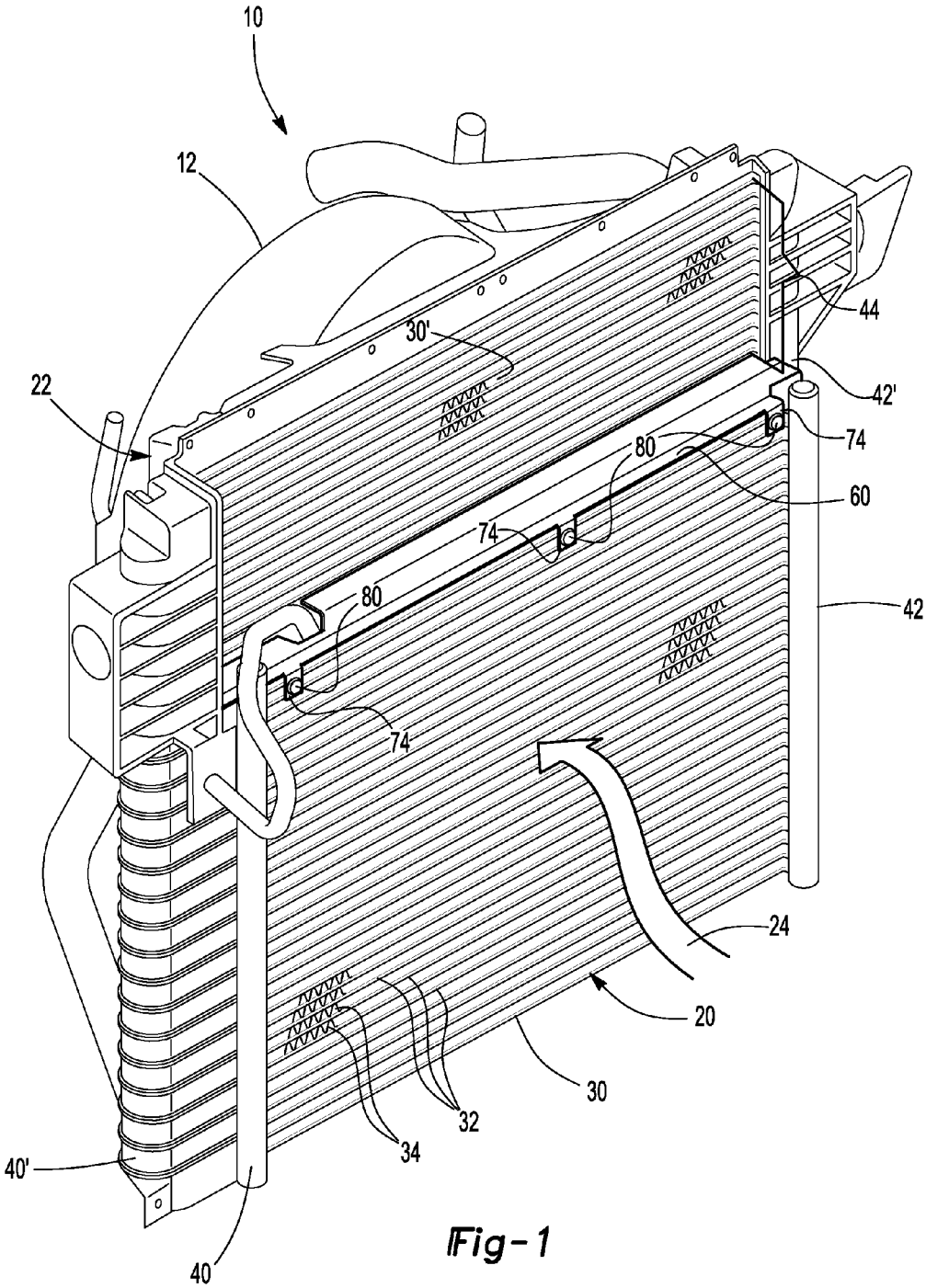
FIG. 1 is a perspective view of an exemplary heat exchanger assembly.
Figure 2:
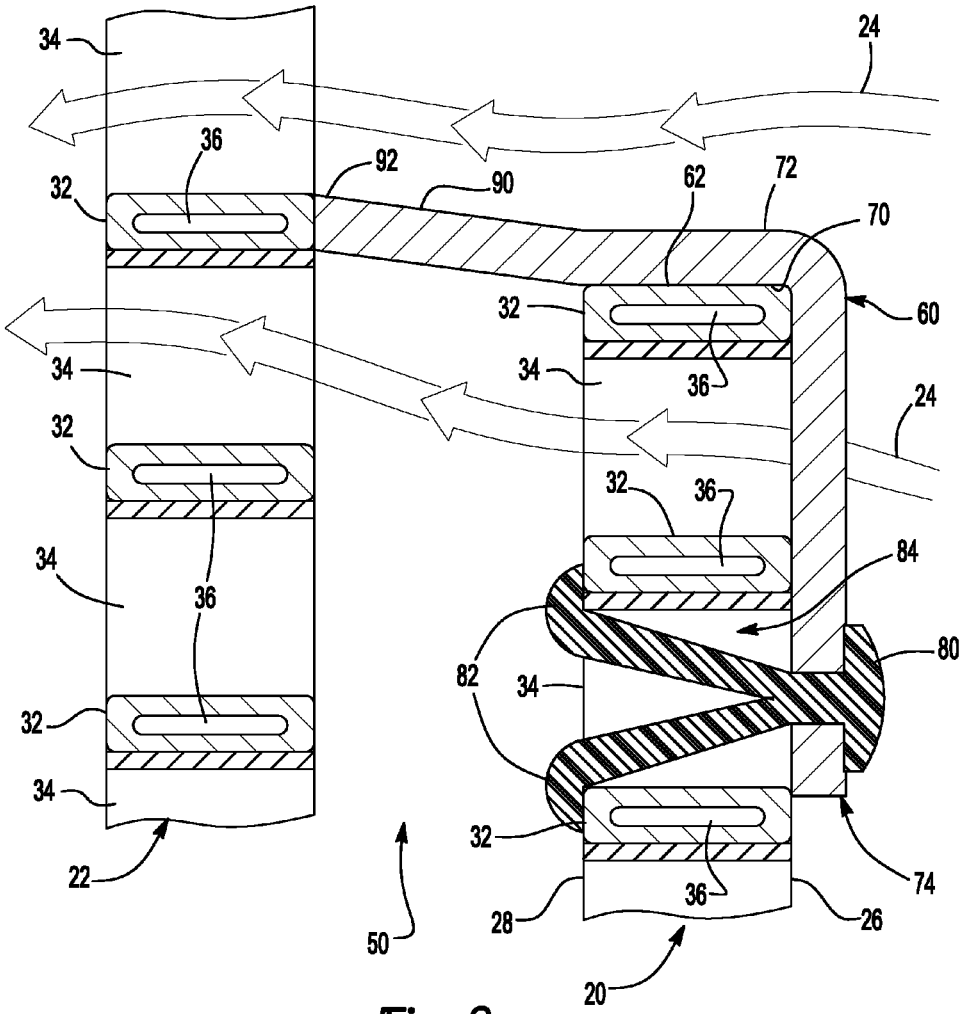
FIG. 2 is a side section view of a portion of a first embodiment of a heat exchanger assembly.

Referring to FIGS. 1 and 2, an exemplary embodiment of a heat exchanger assembly 10 is shown. The heat exchanger assembly 10 may be configured for use in a vehicle, such as a motor vehicle like a car or truck. In at least one embodiment, the heat exchanger assembly 10 may be disposed at a front end of a vehicle and may be part of a front end module that may include a plurality of heat exchangers, a fan shroud 12 that may receive a fan, and various components that facilitate interconnection with and mounting to the vehicle.

The heat exchanger assembly 10 may include a first heat exchanger 20 and a second heat exchanger 22. At least a portion of the first heat exchanger 20 may be positioned upstream from the second heat exchanger 22 such that cooling air 24 located outside the heat exchanger assembly 10 may flow or pass through openings in the first heat exchanger 20 before passing through at least some openings in the second heat exchanger 22. In one or more embodiments, the first heat exchanger 20 may have a shorter height than the second heat exchanger 22. In such an embodiment, cooling air 24 may flow or pass through openings in the second heat exchanger 22 without passing through some openings in the first heat exchanger 20 in regions in which the first heat exchanger 20 is not disposed upstream from second heat exchanger 22.

The first heat exchanger 20 may be configured to cool a first fluid. In at least one embodiment, the first heat exchanger 20 may be a condenser that may be part of an air conditioning system and the first fluid may be an air conditioning refrigerant. The first heat exchanger 20 may have a front side or front surface 26 that faces upstream or toward the flow direction of the cooling air 24 and a back side or back surface 28 that is disposed opposite the front surface 26 and may face toward the second heat exchanger 22.

The first heat exchanger 20 may have a first core 30 that may have a tube-fin construction. As such, the first core 30 may include a plurality of tubes 32 and a plurality of fins 34. The tubes 32 may be spaced apart from each other and disposed in a substantially parallel relationship. Each tube 32 may have a top surface, a bottom surface disposed opposite the bottom surface, and may define at least one passage 36 through which fluid may pass. A fin 34 may be disposed between and may be attached to adjacent tubes 32. The fin 34 may be a louvered fin having a generally serpentine construction that may extend the length of an associated tube 32. The fin 34 may be configured to route cooling air 24 through openings that are at least partially defined by fin 34 to facilitate heat transfer from the first core 30 to the cooling air 24 and the surrounding environment.

First and second headers 40, 42 may be disposed at opposite ends of the first core 30. The first and second headers 40, 42 may include a plurality of spaced apart openings that may each receive a tube 32. As such, the first and second headers 40, 42 may receive and/or direct the first fluid through the passages 36 in the tubes 32 of the first core 30. In at least one embodiment, the first and second headers 40, 42 may include one or more baffles for directing the first fluid on multiple passes through the first core 30. In addition, the first and/or second headers 40, 42 may include an inlet and an outlet through which the first fluid enters the first heat exchanger 20 and exits the first heat exchanger 20, respectively.

A receiver-dryer may be provided with the first heat exchanger 20 in one or more embodiments. The receiver-dryer may act as a reservoir and may include a desiccant that absorbs small amounts of water moisture from the first fluid. The receiver-dryer may be disposed in the first header 40, second header 42, or may be provided outside of the first and second headers 40, 42 and may be fluidly connected to the first heat exchanger 20 via additional tubes.

The second heat exchanger 22 may be configured to cool one or more fluids. For instance, the second heat exchanger 22 may be configured as a radiator and may be configured to cool a second fluid such as an engine coolant.

The second heat exchanger 22 may have a second core 30' that may have a tube-fin construction similar to the first core 30 of the first heat exchanger 20. As such, the second core 30' may include a plurality of tubes 32 and a plurality of fins 34 having similar characteristics as the first core 30. The second core 30' may extend substantially parallel to the first core 30. In the embodiment shown, the second core 30' has an unblocked region 44 in which cooling air 24 does not pass through the first core 30 before passing through the second core 30'. For example, the unblocked region 44 may be located in a region where the first core 30 does not extend next to or in front of the second core 30'. Such a region may be created by providing a second core 30' that has a greater height than the first core 30. In the embodiment shown in FIG. 1, the unblocked region 44 is disposed above the first heat exchanger 20.

The second heat exchanger 22 may also include first and second headers 40', 42' similar to the first and second headers 40, 42 of the first heat exchanger 20. The second core 30' may be spaced apart from the first core 30 by a gap 50 and the first headers 40, 40' and second headers 42, 42' may be spaced apart from each other to help inhibit heat transfer between the cores 30, 30'.

One or more seals 60 may be provided that help direct airflow from the first heat exchanger 20 to the second heat exchanger 22. A seal 60 may be disposed on the first heat exchanger 20 along one or more sides. For instance, a seal 60 may be disposed on a side or surface of the first heat exchanger 20 or first core 30, such as continuously across a top surface 62 of the first heat exchanger 20, to help inhibit air from flowing around the first heat exchanger 20, thereby helping improve heat exchange efficiency from the first core 30 to the cooling air 24.

The seal 60 may be made of any suitable material, such as a polymeric material like a thermoplastic elastomer such as Enduraprene™ 2395. The seal 60 may include a first surface 70 and a second surface 72 disposed opposite the first surface 70. The first surface 70 may face toward and engage the first heat exchanger 20. For instance, the first surface 70 may engage the top surface 62 of the first core 30.

The seal 60 may also include one or more tabs 74. In at least one embodiment, the tabs 74 may be spaced apart from each other and may extend away from the second surface 72. In the embodiment shown, three tabs 74 are provided. The tabs 74 may extend along and may engage the front surface 26 of the first core 30.

Figure 3:
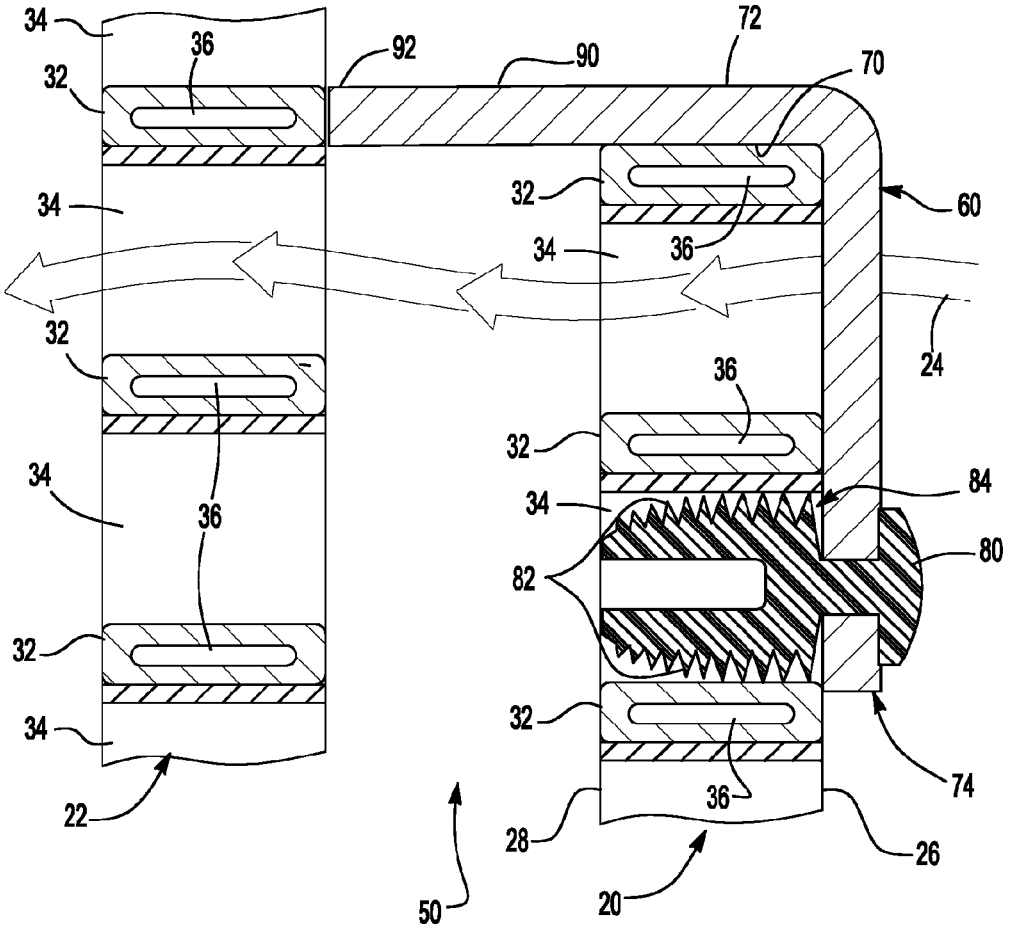
FIG. 3 is a side section view of a portion of a second embodiment of a heat exchanger assembly.

The tabs 74 may include one or more fasteners 80 that facilitate attachment to the first heat exchanger 20. The fasteners 80 may be integrally formed with the tabs 74 or may be provided as separate components. For instance, the fastener 80 may extend through a hole in a tab 74 or may be mounted to the tab 74. In at least one embodiment, the fastener 80 may include one or more hooks or barbs 82 that facilitate engagement and attachment to the first heat exchanger 20. For instance, the fastener 80 may be inserted into an opening 84 that is at least partially defined by a fin 34 and an adjacent tube 32 such that one or more barbs 82 engage the fin and/or an adjacent tube 32 to inhibit removal of the seal 60. The fastener 80 and/or barbs 82 may extend completely through the first core 30 as shown in FIG. 2 or may not extend through the first core 30 and may engage the back surface 28 as shown in FIG. 3. Moreover, the fastener 80 and barbs 82 may be spaced apart from and may not engage the second heat exchanger 22.

The seal 60 may also include an elongated portion 90 that extends from the first heat exchanger 20 toward the second heat exchanger 22. The elongated portion 90 may be disposed in the gap 50 between the first and second heat exchangers 20, 22 such that the elongated portion 90 may be generally cantilevered with respect to the first heat exchanger 20 and extend across the gap 50. The elongated portion 90 may include a distal end 92 that is disposed proximate the second heat exchanger 22. Optionally, the distal end 92 may engage the second core 30' of the second heat exchanger 22 in one or more embodiments. In one or more other embodiments, the elongated portion 90 may extend at an angle with respect to the portion of the seal 60 that engages the top surface 62 of the first core 30 to direct airflow to a specific area or region of the second heat exchanger 22 as shown in FIG. 2. In at least one embodiment, the elongated portion 90 may be substantially planar and may extend substantially parallel to the portion of the seal 60 that engages the top surface 62 of the first core 30 as shown in FIG. 3. For instance, the elongated portion 90 may be positioned such that the distal end 92 generally extends toward a tube 32 of the second core 30' so that airflow immediately above and/or below the elongated portion 90 may be directed toward openings 84 in the second core 30'. The seal 60 may also help separate or inhibit mixing of cooling air 24 that passes on opposite sides of the elongated portion 90. As such, cooling air 24 that passes through the first heat exchanger 20 may be directed toward and pass through the second heat exchanger 22 but may be inhibited from passing through the unblocked region 44. Similarly, cooling air 24 that does not pass through the first heat exchanger 20 may be directed toward and pass through the unblocked region 44. Such a seal configuration may improve heat transfer efficiency from the first heat exchanger 20 to the cooling air 24 by reducing the volume of cooling air 24 that may bypass or flow around the first heat exchanger 20 rather than through the first heat exchanger 20. In the case of a first heat exchanger 20 configured as a condenser, improved heat transfer to the cooling air 24 may help reduce air conditioning system head pressures at high ambient temperature conditions or vehicle idling conditions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An assembly comprising:

first and second heat exchangers each having opposing front and rear faces; and a seal spanning between the heat exchangers, in contact with a top of the first heat exchanger (FHE), and having a tab in contact with and anchored to the front face of the FHE via a fastener extending into an opening in the FHE, and between the faces of the FHE such that barbs of the fastener engage the rear face of the FHE.

2. The assembly of claim 1 wherein the seal includes a distal end that is disposed proximate the second heat exchanger.

3. The assembly of claim 2 wherein the distal end engages the second heat exchanger.

4. The assembly of claim 2 wherein the distal end engages a tube of the second heat exchanger.

5. The assembly of claim 1 wherein the seal extends continuously across the top.

6. The assembly of claim 1 wherein the opening is defined by a fin that is disposed on a tube of the FHE.

7. The assembly of claim 1 wherein the seal is a thermoplastic elastomer.

8. A heat exchanger assembly comprising:

a first heat exchanger having a first core;

a second heat exchanger having a second core that is disposed substantially parallel to and spaced apart from the first core; and a seal in contact with a top side of the first heat exchanger and having a set of tabs extending perpendicularly away from the top side and in contact with a front surface of the first core, wherein each of the tabs includes a fastener that extends at least partially through the first core toward the second heat exchanger to secure the seal to the first heat exchanger, wherein the seal includes an elongated portion that extends in a cantilevered manner from the first core toward the second core, wherein the elongated portion directs cooling air that flows through the first core to the second core, wherein the first core includes a back surface disposed opposite the front surface, wherein each of the fasteners extends from the front surface toward the back surface, and wherein each of the fasteners includes barbs that extend through the first core such that the barbs engage the back surface.

9. The heat exchanger assembly of claim 8 wherein the second core has an unblocked region in which cooling air does not pass through the first core before passing through the second core and wherein the elongated portion inhibits cooling air exiting the first core from passing through the seal and entering the unblocked region.

10. The heat exchanger assembly of claim 8 wherein each of the tabs is spaced apart from each other.

11. The heat exchanger assembly of claim 8 wherein at least one of the barbs engages a fin and a tube along the back surface of the first core.

12. The heat exchanger assembly of claim 8 wherein the elongated portion extends at an angle across a gap disposed between the first and second cores.

13. The heat exchanger assembly of claim 8 wherein the elongated portion is substantially planar and extends substantially parallel to the top side of the first heat exchanger.

14. The heat exchanger assembly of claim 8 wherein the first heat exchanger is a condenser and the second heat exchanger is a radiator.

* * * * *